United States Patent [19]

Gordon et al.

[11] Patent Number: 4,705,197

[45] Date of Patent: Nov. 10, 1987

[54] POUR SPOUT FOR CONTAINERS

[75] Inventors: Robert L. Gordon, Monroe; Roderick W. Kalberer, Salisbury Mills, both of N.Y.

[73] Assignee: International Paper Company, Purchase, N.Y.

[21] Appl. No.: 890,232

[22] Filed: Jul. 29, 1986

[51] Int. Cl.[4] ..... B67D 3/00; B65D 47/00; B65D 5/72

[52] U.S. Cl. ..... 206/604; 222/541; 222/545; 222/556; 222/481; 229/120; 220/270; 220/358; 206/621.7; 206/626

[58] Field of Search ..... 222/545, 571, 481, 541, 222/572, 556, 512, 542; 229/7 R, 17 R; 206/621, 626; 220/260, 270, 359

[56] References Cited

U.S. PATENT DOCUMENTS

| | | | |
|---|---|---|---|
| 3,339,788 | 9/1967 | Lipske | 222/541 X |
| 3,650,458 | 3/1972 | Rausing | 229/17 |
| 3,795,359 | 3/1974 | Rausing | 229/17 R X |
| 3,900,155 | 8/1975 | Rausing | 229/7 |
| 3,938,693 | 2/1976 | Patel | 222/541 X |
| 3,977,591 | 8/1976 | Nartensson et al. | 229/7 R |
| 4,101,051 | 7/1978 | Reil | 229/17 |
| 4,113,103 | 9/1978 | Carlsson | 206/611 |
| 4,122,970 | 10/1978 | Amabili | 222/541 X |
| 4,126,263 | 11/1978 | Martensson | 229/17 |
| 4,197,949 | 4/1980 | Carlsson | 206/611 |
| 4,223,789 | 9/1980 | Reil | 206/605 |
| 4,285,876 | 3/1981 | Ljungcrantz | 229/43 |
| 4,312,450 | 1/1982 | Reil | 206/605 |
| 4,391,385 | 7/1983 | Rausing | 220/307 |
| 4,464,154 | 8/1984 | Ljungcrantz | 493/87 |
| 4,522,305 | 6/1985 | Jacobsson | 206/632 |
| 4,562,936 | 1/1986 | Deflander | 229/7 R X |
| 4,585,498 | 4/1986 | Lagerstedt | 156/69 |

*Primary Examiner*—Joseph J. Rolla
*Assistant Examiner*—Gregory L. Huson
*Attorney, Agent, or Firm*—Walt Thomas Zielinski

[57] ABSTRACT

A pour spout for a paperboard container of either the flat top or gable top type. In one embodiment, a rectangular strip of a rigid plastics material, such as high density polyethylene, is provided with two upwardly liftable, coplanar hinged flaps, integrally formed with the strip. The flaps are aligned with respective vent and pour openings pre-cut in the container top. Upon lifting the flaps from the plane of the strip, an extruded barrier layer (typically a polymer-foil laminate) spanning the pre-cut openings is ruptured and is carried upwardly through the die-cut openings. One opening is a dispensing opening and the other a vent opening. In a second embodiment, a single integral, coplanar and also liftable flap on the rigid strip is employed to define a single pour opening. In a third embodiment, a single integral and copolanar flap on the rigid strip is covered by a flexible strip which is peeled back to expose the flap. The flap is then pushed downwardly to define a single pour opening.

6 Claims, 10 Drawing Figures

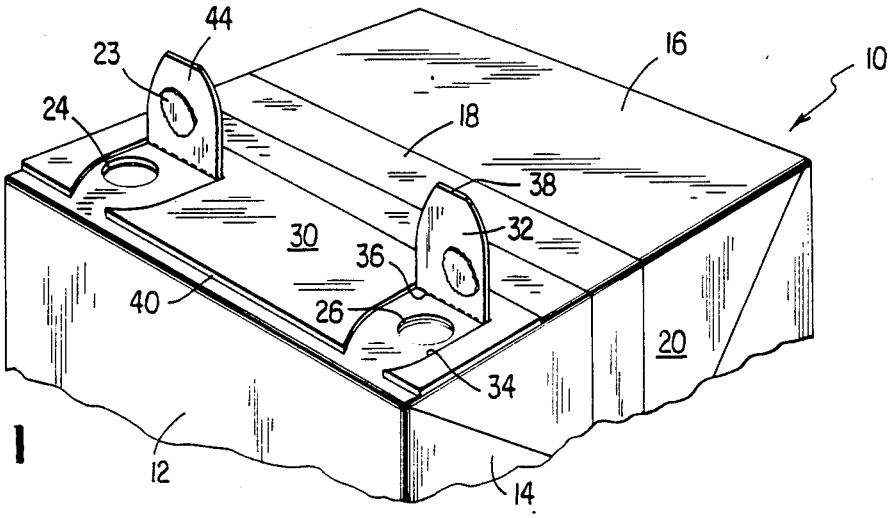
FIG. 1
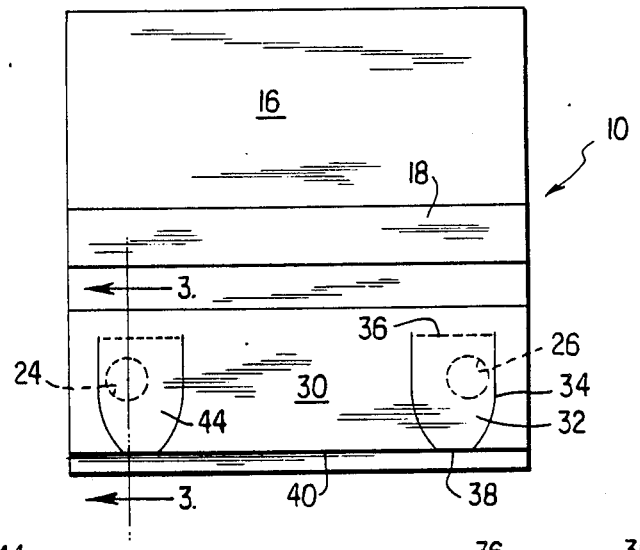
FIG. 2
FIG. 3
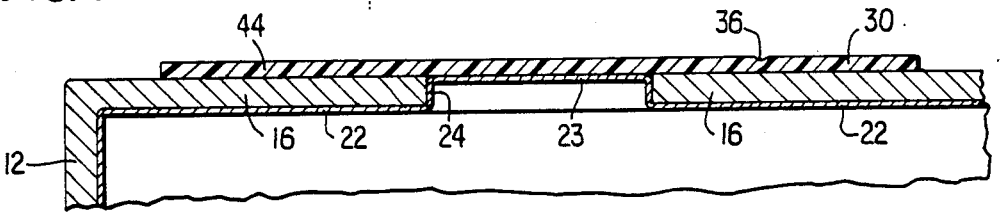
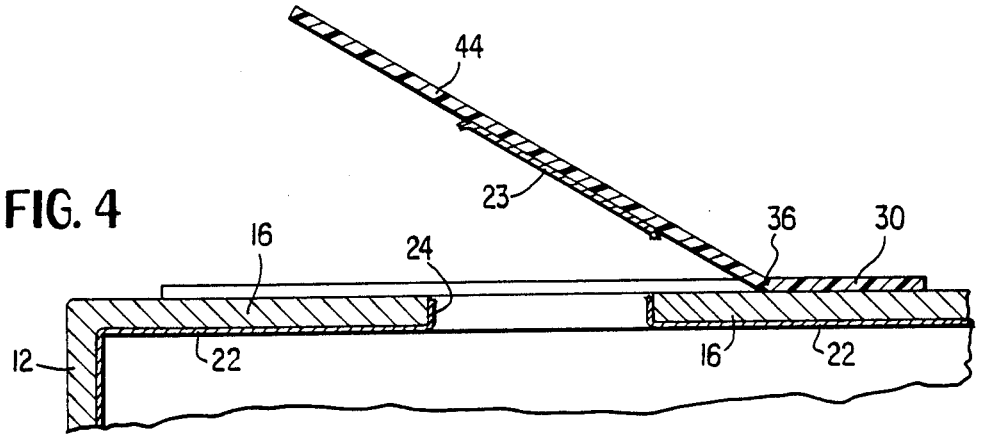
FIG. 4

POUR SPOUT FOR CONTAINERS

BACKGROUND OF THE INVENTION

This invention relates to the art of paperboard containers and more particularly to a frangible seal pour spout for liquid packages. At the present time, two types of conventional containers are used for the packaging of milk, juices and juice drinks, one being square with a gable top or a flat top and the other is rectangular in shape with a gable or flat top. Each of these configurations require easy access to the product that is consumer convenient. This is especially true because of today's asceptic and hot fill technology which requires hermetic sealing of the packages. The ideal spout should have a low profile to allow for package shipping and stacking and be low in cost. All spouts should be compatible with flat top and/or gable top containers.

SUMMARY OF THE INVENTION

According to the practice of one embodiment of the present invention, a relatively rigid vented pour spout opening device for a flat top liquid package of the rectangular or square shape is provided. According to the practice of this first embodiment of this invention, a relatively rigid single rectangular strip of a plastics material, such as high density polyethylene, is sized to match one edge of the top of the rectangular or square package. The strip is sealed to the outside of the package, the strip having two die cut, hinged, pull up tabs or flaps. The tabs are centered on the top of die cut openings in the top wall of the container. A continuous barrier layer, usually formed by extrusion coating and typically formed of one or more layers of a polymer and metal foil, is located on the interior surface of the container top, this barrier layer covering the die cut openings in the container wall. The barrier extrusion layer is heat sealed to a portion of the underside surface of the tabs. In use, the consumer pulls up on both of the tabs to thereby fracture the barrier extrusion layer, pulling a portion of it through the die cut openings to thereby create two openings in the top wall of the container. One of the openings is used as a pour spout, while the other functions as a vent. The two openings in the top wall are as close to the edge of the container as possible to thereby eliminate the liquid surface tension against the package material surface. After pouring, the user snaps closed the two tabs for storage of any of the unused or undispensed liquid in the container.

In other embodiments of the invention, a square or rectangular piece of a relatively rigid plastics material, such as high density polyethylene, is provided with a single pivoted and integral flap. As with the first embodiment, this add on or fitment strip or piece is placed on the top end surface of a flat top or gable top container for liquids, the placement being such that a single dispensing aperture is positioned beneath the pivoted flap. Again, a barrier extrusion layer on the interior surface of the top of the parallelepiped containers covers the single dispensing opening in the top. The lower surface of the pivoted flap is adhesively secured or sealed to the major portion of the barrier extrusion layer which covers the dispensing opening. The pivoted flap may be swung upwardly, away from the interior of the container, to thereby rupture the barrier layer and define a dispensing opening for the contents of the container. In one of the additional embodiments, the pivoted flap is pushed downwardly towards the interior of the container to thereby rupture the barrier layer and define a pour opening for the container contents. In this latter embodiment, a flexible foil strip is secured at one portion to the plastics strip or relatively rigid fitment, for the purpose of sealing the cut between the pivoted flap and the plastic fitment which contains it.

DESCRIPTION OF THE DRAWINGS

FIG. 1 is a partial perspective view of the upper portion of a typical liquid container provided with the relatively rigid vent and pour spout opening fitment of this invention.

FIG. 2 is a top plan view of the carton of FIG. 1.

FIG. 3 is a cross-sectional view taken along section 3—3 of FIG. 2.

FIG. 4 is a view similar to FIG. 3, showing the flap of FIG. 3 after it has been pulled upwardly.

DETAILED DESCRIPTION

Figure 5:
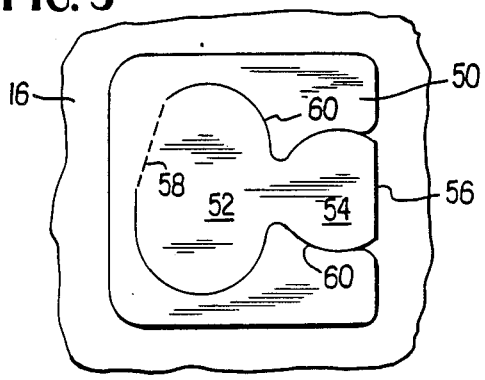
FIG. 5 is a top plan view of a second embodiment of the invention wherein a relatively rigid fitment having a single opening only is employed.

Referring now to FIG. 1–4 of the drawings, the numeral 10 denotes generally a rectangular, flat top type of container fashioned from paperboard or other stiff, resilient and foldable material. The paperboard may include one or more thermoplastic and/or metal foil layers. The precise laminar construction of the paperboard forms, however, no part of this invention. The numeral 16 denotes the top, flat surface of the container, and may carry, typically, a folded over fin 18 which extends to the apex of a triangular fold over portion 20 at opposite sides of the container. For convenience in description, the container may be said to have a front wall 12 and a corresponding (not illustrated) rear wall, with one side wall 14 being illustrated and being opposite another side wall.

As indicated by the dashed lines at FIG. 2, the top wall 16 of the container is provided with two spaced openings, one denoted by the numeral 24 and the other by the numeral 26. These openings extend completely through the thickness of the paperboard. As indicated at FIG. 3, the bottom surface of paperboard 16 is provided with a barrier layer extrusion 22, generally coextensive with a bottom surface of top portion 16.

The numeral 30 denotes a rectangular strip of rigid plastics material, typically high density polyethylene. Strip 30 contains a first integral and pivoted flap 32 defined by cut lines 34. The non-cut portion of the right hand part of strip 30 (as viewed at FIG. 2) defines an integral hinge 36, with the portion of flap 32 opposite hinge 36 being denoted by the numeral 38, the latter being coextensive with edge 40 of strip 30. The numeral 44 denotes a flap of similar construction at the left part of strip 30 as viewed at FIG. 2. The reader will observe that flaps 32 and 44 respectively overlie apertures 24 and 26.

As shown most clearly at FIG. 3, the barrier layer extrusion 22 is secured to the lower surface of top portion 16 by virtue of its having been extruded therewith. The reader will understand, however, that barrier layer 22 need not be extruded with the paperboard, but may be adhered to it in a separate step. The number 23 denotes that portion of barrier layer 22 which is adhesively secured to the bottom surface of flap 44. Here, the reader will recall that flaps 32 and 34 are identical and accordingly a description of one will necessarily be a description of the other, together with their respective connections to the barrier layer 22.

At FIGS. 2 and 3, the position of flaps 32 and 44 is in the sealed configuration. When the user of the container 10 desires to dispense a portion of the container contents, the free edge 38 of each flap is pulled upwardly away from the container interior and the flaps hinge about their respective integral connections 36 with the remainder of strip 30. This upward pulling results in a rupture or tear of barrier layer 23, as indicated at FIG. 4. Upward motion continues until the flaps are substantially perpendicular to the strip 30, as shown at FIG. 1. In this position, the liquid can be dispensed through one of the openings 24 or 26, with the other opening functioning as a vent to prevent the formation of vacuum. After such partial dispensing through one of the openings, the flaps 32 and 44 are pushed down so as to frictionally fit with cut portions 34 of strip 30, the carton now being ready for the next dispensing operation.

Figure 6:
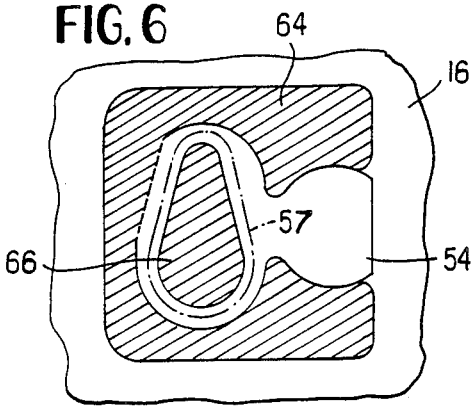
FIG. 6 is a view similar to FIG. 5 and illustrates two adhesive or sealing patterns and the aperture which the fitment of FIG. 5 covers.

While the use of a relatively rigid fixture or add-on strip 30 of the embodiment of FIGS. 1–4 yields the advantage of a vent hole in combination with a dispensing hole, there are some situations wherein the vent hole may be omitted without the formation of a significant vacuum to inhibit pouring of the liquid from the container. In such sized containers, a fixture similar to 30 of FIGS. 1–4 having a single flap may be employed. FIGS. 5 and 6 illustrate such a construction.

Referring now to FIGS. 5 and 6, the numeral 50 denotes a generally rectangular pieces of rigid plastics material such as high density polyethylene, and is typically of 20 to 30 mils thick, as is strip 30 of the previously described embodiment. The numeral 52 denotes a flap integral with piece 50, the flap having an integral tongue 54. Die cuts 60 define the tongue and flap. The numeral 58 denotes an integral hinge joining flap 52 to the remainder of fitment 50. The numeral 56 denotes the free edge of extension 54 and is adapted to be grasped, as will described. As indicated by irregular lines surrounding FIG. 5 (and FIG. 6) the fitment 50 is adhered on the top surface of top panel 16 of a liquid type container.

FIG. 6 illustrates adhesive portions or seal areas 64 on the lower surface of fitment 50 for adhering it to the top 16 of a liquid container. The numeral 66 denotes the adhesive or heat seal area between the lower portion of flap 52 and a barrier layer seal, such as seal 22 of the previously described embodiment. Numeral 57 denotes an aperture which extends completely through the thickness of paperboard 16, this opening being initially covered by barrier layer extrusion and secured to the underside of flap 52, entirely similar to the construction indicated at FIG. 3 of the previously described embodiment.

In operation, the user grasps the end of tab 54 to thereby lift flap 52 away from the container interior, as flap 52 pivots along integral hinge line 58. This results in a rupture of the barrier layer seal adhered to the lower portion of flap 52, entirely similar to the action illustrated at FIG. 4 with respect to the previously described embodiment.

Figure 7:
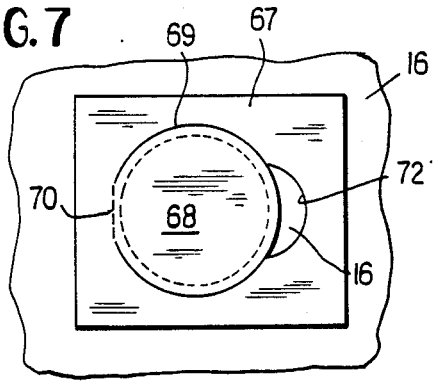
FIG. 7 is a plan view of yet another embodiment of the invention.

Referring now to FIG. 7 of the drawings, yet another embodiment is illustrated, again adopted to be used to cover a single opening in either a flat top or a gable top container. The numeral 67 denotes a rectangular piece of rigid plastic, such as high density polyethylene and typically 20 to 30 mils thick. Fitment 67 is adhere to the top surface of top panel 16. The numeral 68 denotes an integral flap defined by die-cut line 69, while numeral 70 denotes an integral hinge joining flaps 68 to the remainder of fitment 67. The numeral 72 denotes a cut-out extending completely through the thickness of fitment 67. The operation of the embodiment of FIG. 7 is similar to that with respect to previously described embodiment of FIG. 5, except that the user here grasps that peripheral portion of flap or tongue 68 which is opposite hinge 70, this grasping being made possible by cut-out recess 72.

Figure 8:
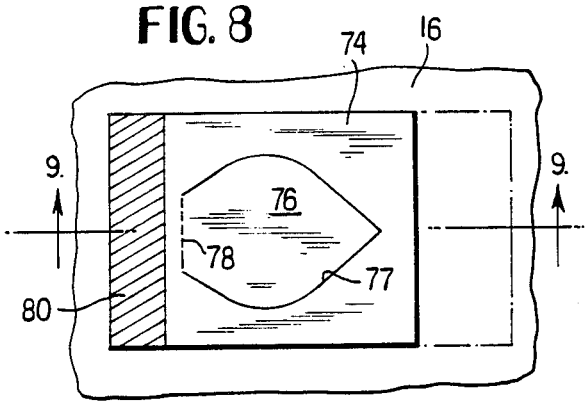
FIG. 8 is a plan view of still another embodiment of the invention.
Figure 9:
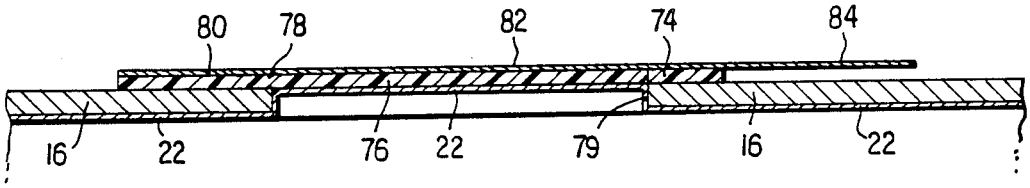
FIG. 9 is a view taken along section 9—9 of FIG. 8.
Figure 10:
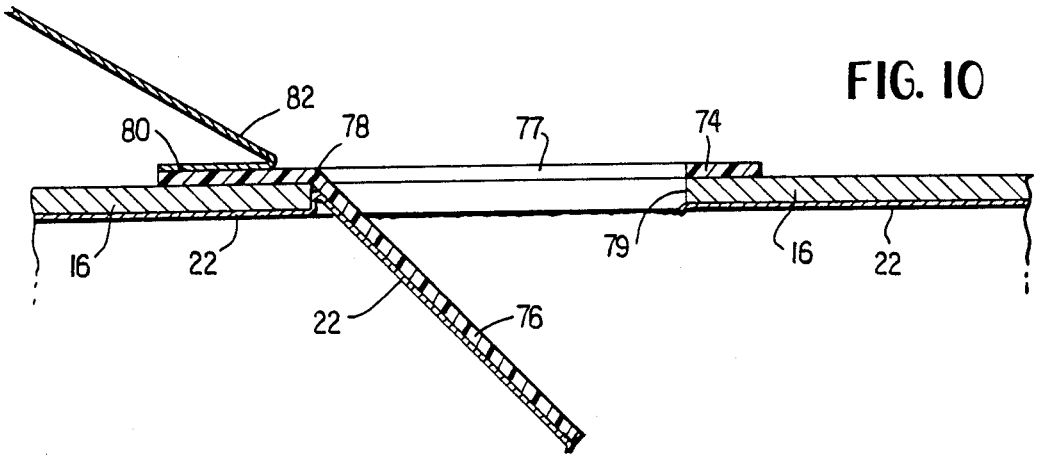
FIG. 10 is a view similar to FIG. 9 and illustrates the configuration of the relatively rigid fitment after its flap has been pushed down.

Referring now to FIGS. 8–10 of the drawings, yet still another embodiment is illustrated wherein a add-on fitment is provided with an integral and pivoted tongue, the tongue being adapted to be pushed down into the interior of the carton by the user to thereby rupture the barrier layer extrusion and permit pouring or dispensing of the liquid contents from the container. The numeral 74 denotes a generally rectangular fitment, similar to those described with respect to the embodiments of FIGS. 5 and 7, the fitment including an integral tongue 76 defined by die cut lines 77. An integral hinge 78 is defined by those portions surrounding tongue 76 which are not die cut. The numeral 80 denotes an adhesive zone on the top of fitment 74, adhesive zone 80 adapted to secure one end of a rectangular, peelable metal cover strip to the fitment, as will presently be described with respect to FIGS. 9 and 10. Referring now to FIGS. 9 and 10, the peelable metallic foil is denoted by the numeral 82 with one end thereof being adhesively secured to portion 80 of fitment 74. The opposite end of foil 82 is denoted by the numeral 84 and is adapted to be grasped by the user. In use, end 84 is grasped and pulled towards the left as viewed at FIG. 9, to thereby uncover flap 76. The user then pushes down on the top of flap 76 with a finger, to thereby rupture barrier extrusion layer 22, thereby enabling the liquid contents of the container to be poured through opening 79 of paperboard top 16. The metallic foil 82 is used to reseal the opening after the contents have been poured.

Any of the fitments described herein also can be located at either of the two sloping panels of a gable top. Thus, the fitments exhibit utility as pour spouts when located at a flat portion of either type container and yield a superior opening, pouring and releasability with respect to conventional pour spouts.

What is claimed is:

1. A frangible seal construction for a container formed from paperboard, the container adapted to carry a liquid therein, such as a potable liquid, the container having a flat wall portion and an aperture extending through said flat wall portion, a rupturable barrier layer seal on the interior wall surface, the barrier layer covering the container wall aperture, a rigid strip having a rigid flap integrally hinged thereto, the flap normally lying in the plane of the rigid strip and formed from the rigid strip by cut lines in the rigid strip, said rigid strip being sealed to the exterior surface of the container at said flat wall portion with said flap overlying said aperture, the container innermost surface of said flap being adhesively secured to said barrier layer seal through said opening, whereby when the flap is pivoted the barrier layer seal is broken and the contents of the container can be dispensed through the aperture and whereby said rigid flap can be reclosed to frictionally fit back within said rigid strip.

2. The seal construction of claim 1 including a flexible and peelable strip secured to the container-outermost side of the rigid strip and in sealing yet peelable bond contact with the rigid strip and the flap, the peelable strip being of a size and configuration so as to cover both the flap periphery and those portions of the rigid strip contiguous to the flap periphery, one edge portion of the peelable strip extending beyond one edge portion of the rigid strip, whereby the peelable strip may be grasped and pulled off of the flap, and whereby the flap is adapted to be then pushed downwardly towards the interior of the container and thereby rupture the barrier layer seal, to thereby permit dispensing of the container contents through said container wall aperture.

3. The seal construction of claim 1 wherein that region of the rigid strip which is adjacent the flap periphery and which is diametrically opposite the integral hinge of the flap is cut away to thereby define a finger recess and therby enable a portion of the flap to be grasped and pulled in a container-outward direction.

4. The seal construction of claim 1 wherein that region of the pivoted flap opposite its integral hinge with the rigid strip carries and integral extension, the integral extension extending to an edge of the rigid strip, whereby the end of the flap integral extension can be grasped and pulled in a container-outward direction.

5. The seal construction of claim 1 wherein said rigid strip is generally rectangular in plan view and carries a pair of said pivoted flaps, spaced from each other and wherein the end of each flap opposite its integral hinge is on a longitudinal edge of the rigid strip, and wherein each flap overlies a respective aperture in the container wall, one opening being a pour opening and the other opening being a vent opening.

6. The seal construction of claim 5 wherein the top of the container is substantially flat, and wherein the container is polygonal in cross-section, and wherein the rectangular rigid strip is placed with its longitudinal axis parallel with the contiguous to an edge of the top of the container, the length of the rigid strip being not longer than the length of said one edge of the top of the container.

* * * * *